US011686042B2

(12) United States Patent
Porter

(10) Patent No.: US 11,686,042 B2
(45) Date of Patent: Jun. 27, 2023

(54) SURFACE COVERING FOR USE AS ARTIFICIAL MOSS, GRASS, ROOTS, HAIR, AND THE LIKE

(71) Applicant: DISNEY ENTERPRISES, INC., Burbank, CA (US)

(72) Inventor: Steven J. Porter, Winter Garden, FL (US)

(73) Assignee: Disney Enterprises, Inc., Burbank, CA (US)

( * ) Notice: Subject to any disclaimer, the term of this patent is extended or adjusted under 35 U.S.C. 154(b) by 268 days.

(21) Appl. No.: 17/096,783

(22) Filed: Nov. 12, 2020

(65) Prior Publication Data

US 2022/0145529 A1 May 12, 2022

(51) Int. Cl.

| | |
|---|---|
| ***D06M 15/564*** | (2006.01) |
| ***A41G 1/00*** | (2006.01) |
| ***D06M 15/55*** | (2006.01) |
| ***D06M 101/00*** | (2006.01) |
| ***A41G 3/00*** | (2006.01) |

(52) U.S. Cl.

CPC ..... *D06M 15/564* (2013.01); *A41G 1/009* (2013.01); *A41G 3/0083* (2013.01); *D06M 15/55* (2013.01); *D06M 2101/00* (2013.01)

(58) Field of Classification Search

CPC . A41G 1/009; A41G 1/00; A41G 3/00; A41G 3/0083; E02D 5/04; B32B 27/12; D06N 7/0005; D06N 7/0063; D06N 7/0071; E01C 13/083; E01C 13/08; D10B 2505/202; A01G 22/30

See application file for complete search history.

(56) References Cited

U.S. PATENT DOCUMENTS

2011/0262665 A1* 10/2011 Olde Weghuis ..... D01D 5/253 428/17
2013/0034671 A1* 2/2013 George ..... D01F 1/106 428/17
2016/0198785 A1* 7/2016 Hormay ..... A41G 1/00 428/17

FOREIGN PATENT DOCUMENTS

DE 594803 C * 3/1934
KR 20070065544 A * 6/2007

OTHER PUBLICATIONS

Espacenet translation of KR20070065544A. (Year: 2007).*
Espacenet translation of DE594803C. (Year: 1934).*

* cited by examiner

*Primary Examiner* — Jeremy R Pierce
*Assistant Examiner* — Christine X Nisula
(74) *Attorney, Agent, or Firm* — Dorsey & Whitney LLP

(57) ABSTRACT

A surface covering for use as a moss covering or patch of grass via application to a surface or substrate. The surface covering provides a decorative and durable and easily maintained surface covering. The covering is fabricated using groups of fibers, such as metallic, plastic, or other material fibers, e.g., stainless steel fibers or strands available commercially as steel wool or the like. The fibers or strands provide a core of a body of each blade or piece of the surface covering, which is useful to replicate a blade of grass or moss or to mimic a strand of hair. Each body of the strands further includes an outer layer or coating, which can be formed by painting, e.g., with an epoxy or other useful material that may be colored, the mesh of metal fibers to provide a durable body with a desired look and feel.

34 Claims, 6 Drawing Sheets

SURFACE COVERING FOR USE AS ARTIFICIAL MOSS, GRASS, ROOTS, HAIR, AND THE LIKE

BACKGROUND

1. Field of the Description

The present description relates, in general, to artificial coverings used to replicate nature such as artificial turf, topiaries, and the like, and, more particularly, to a surface covering (and the method of making such a covering) for use in place of natural coverings of surfaces and objects, e.g., in place of moss, grass, air plant roots, robotic and other figure hair, and so on.

2. Relevant Background

In amusement parks, water parks, resorts, and many other facilities, there is an ongoing demand for ways to create inviting and welcoming settings that are also easy and less expensive to maintain. Also, it is desirable for the settings to include features that are natural and often match the theme of a space such as with plants from a particular part of the world.

Today, facility designers and operators often use manufactured or fabricated elements to replace plants and other natural features. For example, artificial turf may be used in place of grass, and plastic-leaved plants may be used in place of bushes, trees, and the like. The challenge continues to be how to fabricate these items so that they are durable while also appearing to the observer to be real or non-artificial.

As another specific example, moss is a common feature in natural landscapes. It grows on a variety of surfaces and has a distinctive organic appearance that can make otherwise sterile environments come to life. Replacing a grown and growing moss with an artificial moss is desirable because moss is often difficult to grow and maintain on many facility surfaces. Unfortunately, artificial moss products are typically made from organic or other delicate materials to try to achieve the aesthetic look of natural moss. While suitable for potted plants and some indoor applications, the presently available moss products do not age well. Moreover, existing artificial moss is difficult or, in some cases, nearly impossible to clean without damaging it. Further, available moss products are often not fire resistant and do not withstand storms and sunlight, all of which is needed in many outdoor settings.

Hence, there remains a need for new products to replace existing artificial moss and similar items that better meet the needs of facility designers and operators. Preferably, the new products would be relatively inexpensive to manufacture, would be durable even in outdoor settings, and would be more readily cleaned and otherwise maintained.

SUMMARY

The inventor recognized that a moss carpet or "surface covering" can be fabricated by using the fibers of steel wool as the base. These fibers can be coated, such as with an automotive epoxy, or other durable paint, and then cut to a desired length to match a covering being replicated such as moss, grass, hair, or the like. Stippling or other techniques can be used to provide tiny buds or leaves on an exposed end of the epoxy-coated fibers to further enhance the look of the surface covering in the moss-like carpet example. An integrally colored base may be attached to the other end to improve the overall look and to facilitate attachment of sections or groups of the epoxy-coated and stippled fibers to a surface or to a support substrate (which, in turn, may be attached to a surface or object).

More particularly, a surface covering is provided that includes a base for attaching the surface covering to a substrate or surface. The covering includes a plurality of strands with each including an elongated body with a first end attached to the base and a second end distal to the first end. The elongated body includes a core and an outer layer coating the core.

In some embodiments, the core is formed of a metal fiber such as a steel wool fiber. Particularly, embodiments have been produced using a stainless steel wool fiber with a coarseness in the range of 50 to 120 microns (with larger fibers or more coarse fibers being well suited for many outdoor applications).

In the same or other embodiments, the outer layer of the body may be a layer of a paint. For example, the paint or coating may be an automotive urethane of a desired color. Further, it may be useful for a plurality of the strands each to further include a head or knob stippled onto the second end, and this head may be formed of a volume of an integrally colored epoxy. In such cases, the head may further include a layer of paint on an outward facing surface. In these or other implementations, the base of the surface covering used to attach the covering to surfaces or objects may be formed of a colored epoxy.

DETAILED DESCRIPTION OF THE PREFERRED EMBODIMENTS

Briefly, the following description describes a surface covering for uses including artificial foliage, such as a moss covering or patch of grass, for application to a surface or substrate. The inventor recognized that a durable and more easily maintained surface covering could be fabricated using groups of (or a plurality of) fibers, such as metallic, plastic, or other material fibers (e.g., stainless steel fibers or strands available commercially as steel wool or the like). The fibers or strands provide a core of a body of each blade or strand of the surface covering (e.g., to replicate a blade of grass or moss or to mimic a strand of hair). Each body further includes an outer layer or coating, which can be formed by painting (e.g., with an epoxy or other useful material that may be colored) the mesh of metal fibers to provide a durable body with a desired look and feel. In this way, the surface covering is inexpensive, durable, resistant to weather and sunlight, washable such as with a high pressure spray, and, in many cases, fire resistant.

In this way, each body representing a blade or piece of the surface covering has a coating that hides or disguises the use of a metallic core, and, in one embodiment, each body is epoxy-coated (or has an epoxy coating or outer layer). One end of the body may then be attached to a support substrate or groups or sets of the bodies may be attached directly to a surface for which a covering is desired. The exposed ends (typically prior to such attachment) may be stippled such as with a paint (e.g., one that is leaf-colored when the surface covering is used to provide a moss-like covering) in a way that adds visual texture as well as color that resembles the covering being imitated (e.g., a particular shade of green to resemble small outer leaves of a moss). The paint used in the stippling, to provide a leaf structure or other aspect of the covering, is chosen so that when dried it is pigmented throughout the surface covering and so that it is robust against environmental exposure and heavy use (at least for many planned applications for such surface coverings). The entire surface covering can then be adhesively attached (or otherwise attached) to almost any surface.

Figure 1:
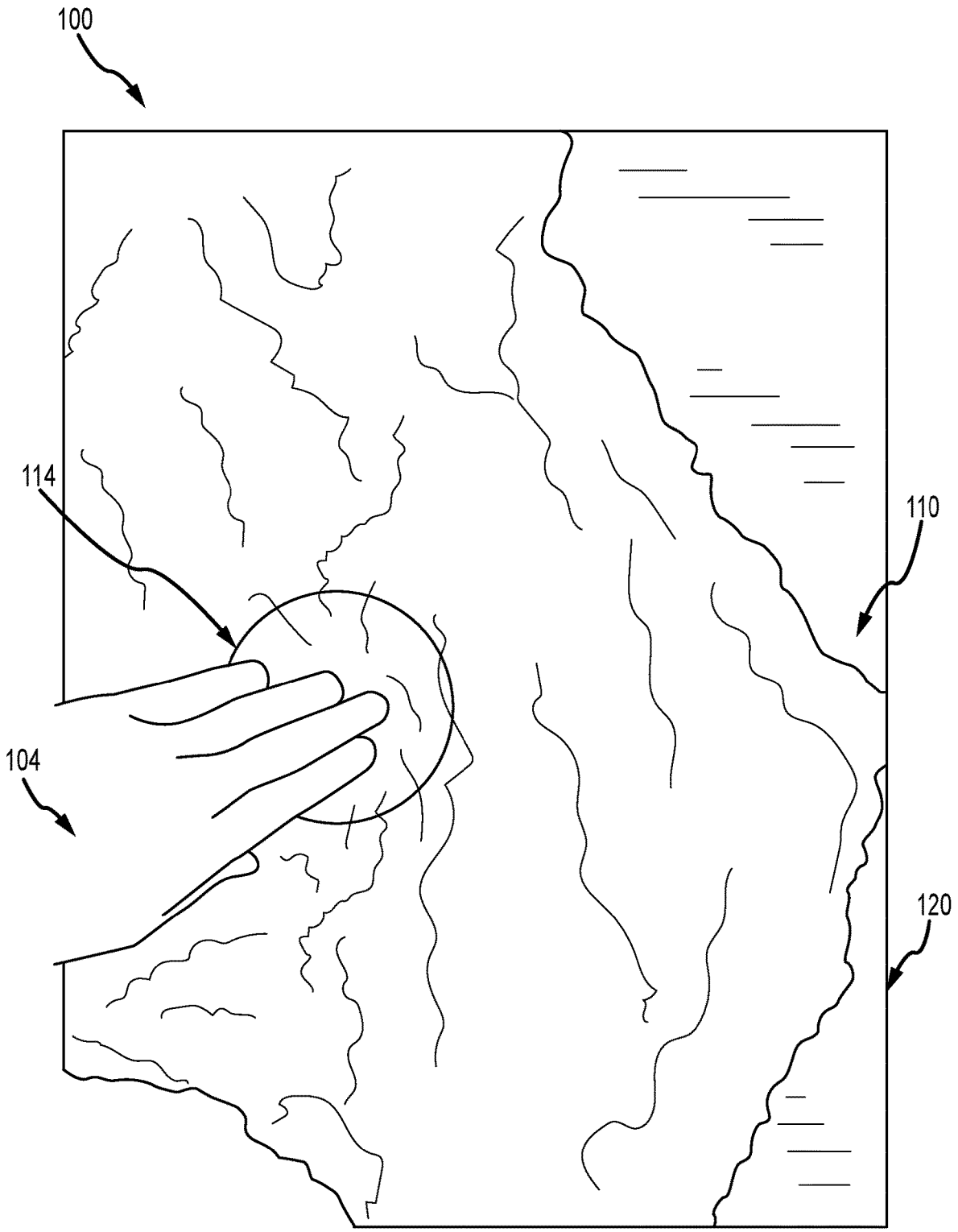
FIG. 1 is a top view of a covered assembly showing a substrate or surface of an object after (or during) application of a surface covering of the present description.

FIG. 1 illustrates an assembly or object 100 making use of the surface covering techniques taught herein to provide artificial foliage or a topiary. In this example, the assembly 100 includes a substrate or surface 120 of an object (such as support structure in the form of landscaping objects including rocks, trees, sloped or flat objects near walkways, and so on). A worker's hand 104 is shown applying a piece or section (or slice as discussed below) 114 of a surface covering 110 (or sheet of surface covering material) to the substrate/surface 120 (such as with an adhesive provided on the surface 120 or on bottom ends of fibers making up the piece/section 114). In this example, the surface covering 110 is fabricated to take on the appearance of moss and to have a moss-like texture in some cases. In such an implementation, the strands or blades in the surface covering 110 typically will be green or another desired color and will include knobs or heads on the top or outer (or second) ends of each or some subset of the bodies of the strands to imitate leaves, bulbs, or the like. These heads/knobs may be omitted if the covering 110 is to be used as artificial grass or turf (or for other uses such as roots of air plants, hair of a robot or sculpture, or the like).

Figure 2:
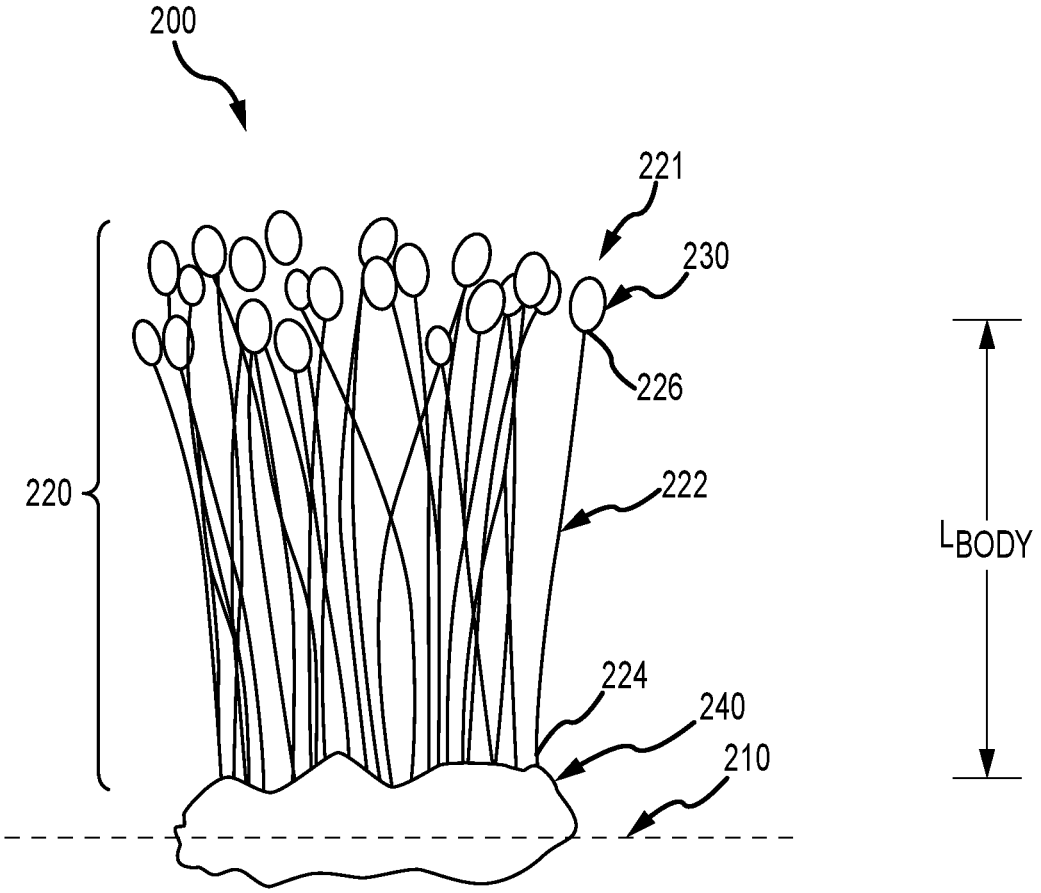
FIG. 2 is a side view a portion of an covered assembly or object, such as that shown in FIG. 1, illustrating in more detail a slice or section of a surface covering of the present description.
Figure 3:
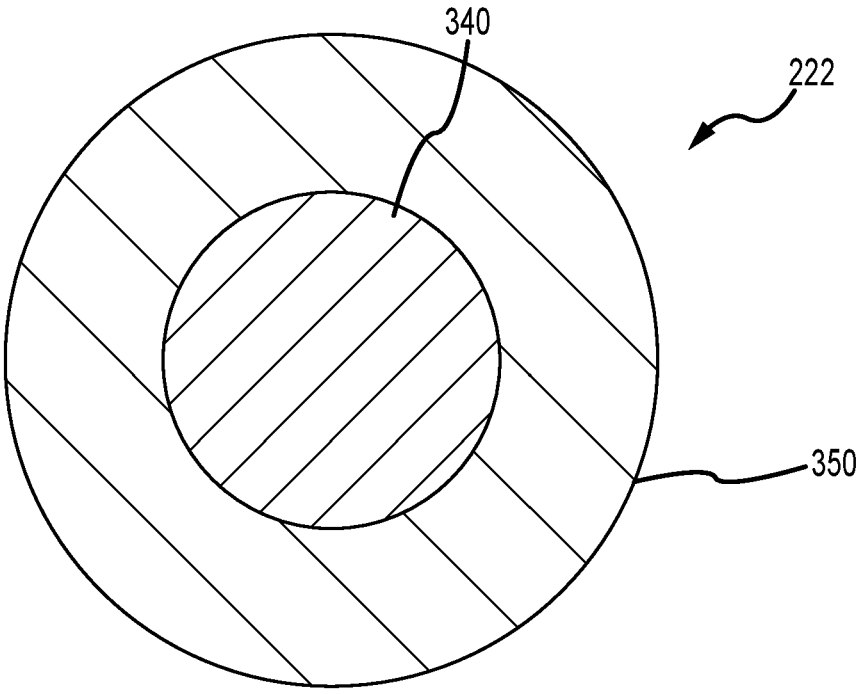
FIG. 3 is a sectional view of a body of a strand or blade of the slice or section of the surface covering of FIG. 2.

FIG. 2 is a side view a portion of a covered assembly or object 200, e.g., an implementation of assembly 100 of FIG. 1. FIG. 2 illustrates in more detail a slice or section 220 of a surface covering of the present description (which would include the slice/section 220 and in many cases, one-to-many more of such sections 220 to cover a desired surface area). FIG. 3 is a sectional view of a body 222 of a strand or blade 221 of the slice or section 220 of the surface covering of FIG. 2.

As shown, each slice/section 220 that is used to form the surface covering includes numerous (or a plurality of) blades or strands 221. These are attached together to a substrate, surface, or support element 210 via an adhesive or other technique using a sectional base 240, e.g., an epoxy material or the like, which may be colored (e.g., integrally colored) to suit the assembly 200 such as to match the color applied to the strands 221, to provide a soil or earthen appearance, to match surrounding object surfaces, and so on. The density of the strands/blades 221 in the slice/section 220 may be varied widely to practice the invention and typically is selected to better replicate the look and texture of the covering being replicated, e.g., to have a density similar to natural moss, grass, roots, hair, and the like. Likewise, the length, $L_{Body}$, of the strands/blades 221 may widely vary to suit differing applications and to match the covering being replicated such as 0.5 to 1 inches for many mosses, 1 to 3 inches or more for many grasses, 4 to 12 inches for roots, 1 to 18 inches or more for hair, and so on.

The strand or blade 221 has an elongated body 222 that extends from a first or bottom end 224, which is used to affix the strand 221 via sectional base 240 to a substrate or support element 210, to a second or top end 226. In the moss implementation shown, a head or knob 230 is provided on the second or top end 226, and the head 230 may be oblong and/or spherical in shape as shown. The head 230 is formed of a paint or other material such as an epoxy paint or durable material that may be colored to suit the application (e.g., a green chosen to imitate bulbs or leaves of moss). In other embodiments, it may be desirable to omit the heads/bulbs 230 such as for surface coverings imitating grass or hair. The head 230 is often provided via stippling or similar techniques, and, as a result, often will be relatively small such as with outer dimensions less than ⅛ inches, less than 1/16 inches, or the like.

As shown in FIG. 3, the body 222 of the blade/strand 221 has an inner core 340, and this may be provided with relatively small diameter fiber of a durable material such as a plastic or metal. In some embodiments, steel fibers such as those found in steel wool materials are used to provide the core 340, with stainless steel (SS) wool fibers used in some prototypes. The diameter of the core 340 may be varied to suit a desired look and feel (e.g., 50 to 120 microns or more), with some prototypes using a relatively coarse SS wool (e.g., 120 micron fibers) to provide a desired stiffness to replicate a moss carpet and to be rigid enough to withstand pressure washing and environmental conditions without losing the look and texture of a moss.

To provide a desired appearance, the body 222 also includes an outer layer or coating 350 that encapsulates the core 340. This acts to hide the presence of the core 340 (e.g., a metallic, shiny center member) while also being useful to provide blades/strands 221 of a desired color. To this end, the outer layer or coating 350 may be formed of a colored material, e.g., brown or a green for moss and grass, a range of colors for hairs, white or gray for roots, and so on. Hence, many paints may be used to provide the outer layer or coating 350. When high durability for outdoor use and for withstanding washing is desired, it may be useful to choose a urethane or similar material/paint for the layer/coating 350. In some useful prototypes, an automotive urethane or urethane car paint was used to coat the fiber/core 340 of the body 222, but it will be understood that many other materials including a wide variety of paints may be used to provide the coating 350 to provide the blade/strand 221.

At this point in the description, it may be useful to describe the useful features and advantages identified by the inventor for the surface covering formed to provide artificial moss carpets through the use of SS wool and automotive urethane coatings. The moss carpet can be made to simulate different depths of moss. The moss covering is fabricated from sustainable materials allowing it to withstand harsh weather conditions for many years. The durable urethane coating and stainless steel construction of the moss make it easy to clean with water pressure and brushes. The moss surface covering is designed to be easily applied to any sound surface or substrate including plaster, rockwork, façade, hardscape, metal, glass, and wood. The new moss surface covering will not melt or drip when exposed to extreme heat and can be made to be fire resistant. The moss surface covering is integrally colored and resistant to fading, chipping, and scratching. The moss surface covering is also firm even with its delicate appearance.

Figure 4:
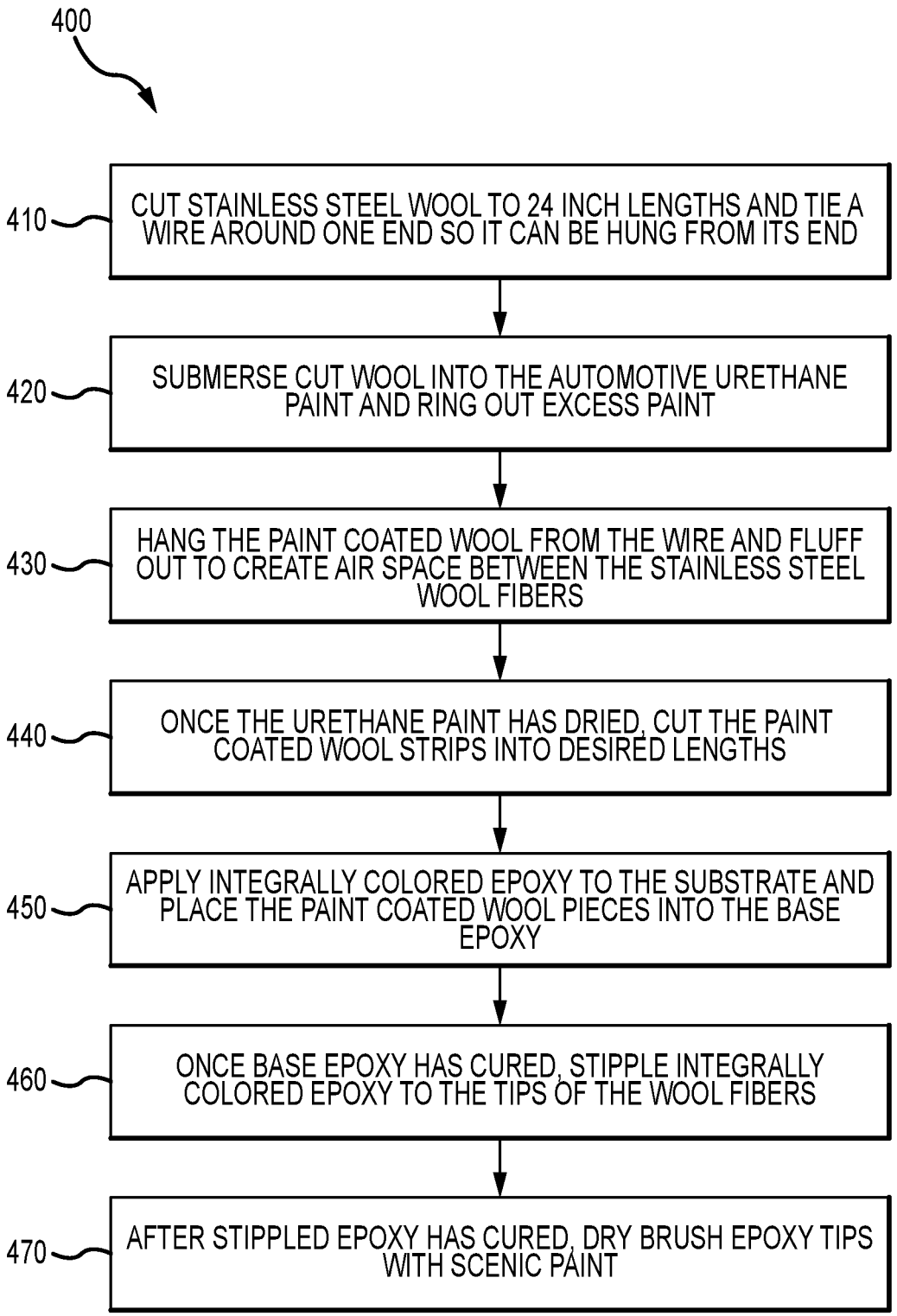
FIG. 4 is a flow diagram of a method of fabricating a surface covering, such as coverings of FIGS. 1 and 2.

FIG. 4 is a flow diagram of a method 400 of fabricating a surface covering, such as coverings 100 and 200 of FIGS. 1 and 2, respectively. The method 400 begins at 410 with cutting the fibrous mesh material (e.g., SS wool) into useful lengths for later processing steps. For example, SS wool may be chosen to provide the cores/fibers of the surface covering, as raw SS wool comes in a variety of wire sizes that can be used to create a wide range of different effects from grass to fine moss. Also, the use of SS or another metallic wool may be desirable as it allows the fabricated surface covering to be bent, manipulated, and shaped to give the strands/blades of the covering an organic appearance (or other desired look and feel). The SS wool may be cut into 24-inch lengths. A wire may then be tied around each end so that it can be hung from its end during later processing steps.

Figure 5:
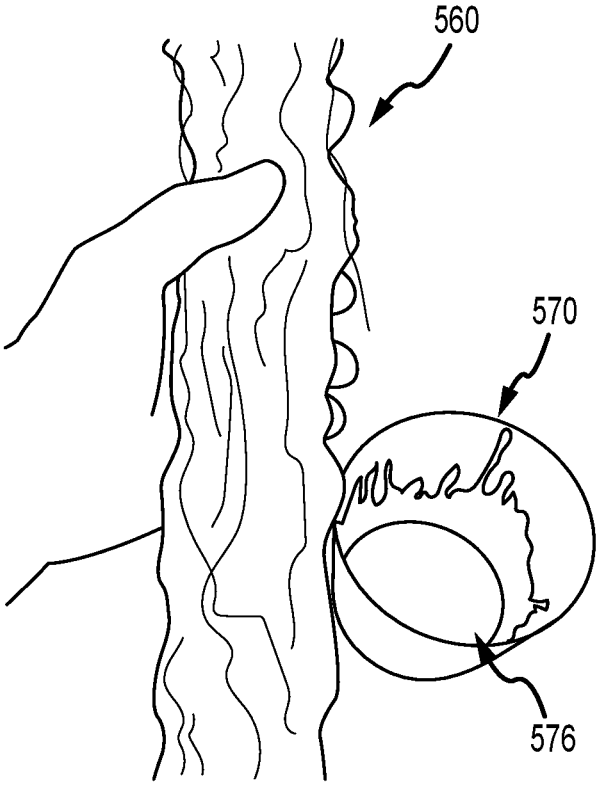
FIG. 5 is a top view of a container used to coat fine fibers to form a log of paint-coated fibers.

The method 400 continues at 420 with submersing the cut wool from step 410 into a paint (e.g., automotive urethane paint for outdoor settings or a water-based paint or the like for interior uses) and then ringing out or removing excess paint. Step 420 is used to form the outer coating or layer in the body of each strand or blade of the surface covering. In step 430, the paint-coated SS wool is hung from the wire tied around its ends in step 410 for drying. As part of step 430, the epoxy (or paint) covered SS wool fibers are fluffed out or otherwise manipulated to create air spaces between the fibers and/or to define a density of the finished surface covering. FIG. 5 illustrates a log 560 of epoxy-coated SS fibers after they have been removed from a container 570 of paint 576 and allowed to dry. FIG. 5 is useful for illustrating that the epoxy-coated fibers of the log 560 are intertwined and held together due to the makeup of SS wool as the base material and due to the coating of their external surfaces with paint 576.

Figure 6:
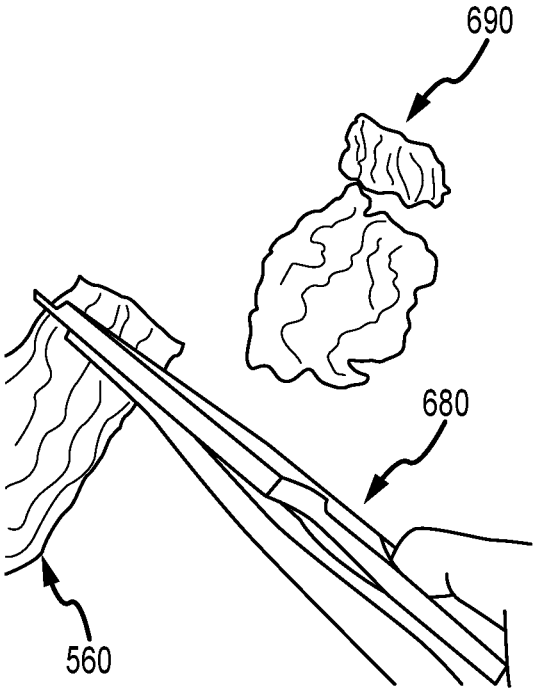
FIG. 6 illustrates the fabrication step of cutting a fiber log into slices for use in forming a surface covering.

In step 440, the method 400 continues, after the paint or outer layer/coating has dried, with cutting the logs of the paint-coated wool fibers into desired lengths (i.e., a desired body length, $L_{Body}$, as shown in FIG. 2). FIG. 6 illustrates a cutting tool 680 being used to cut the log from step 430 into slices 690 of the desired length (e.g., 0.5 to 1 inches or more for moss). In step 450, one-to-many slices 690 are placed into material (e.g., a colored epoxy or the like) to form a section of a surface covering, and step 450 may also include applying integrally colored epoxy to the surface or substrate to which the section will be applied.

The method 400 continues at step 460 with, once the base element's material has cured or hardened, forming heads or knobs on each body (e.g., on each epoxy-covered SS wool fiber). This may include stippling a paint such as an integrally colored epoxy to the tips (e.g., outer or second ends 226 of the bodies 222 of FIG. 2) of the SS wool fibers. Then, after the stippled epoxy has cured to form the heads/knobs, additional paint (e.g., scenic paint) may be applied in step 470 upon the heads/knobs to achieve a desired coloring or look for the section or piece of the surface covering. The method 400 may further include applying the section or piece to the substrate that was prepped in step 450 or directly to a desired surface (e.g., with a high-strength adhesive) so as to form a surface covering of the present description.

Figure 7:
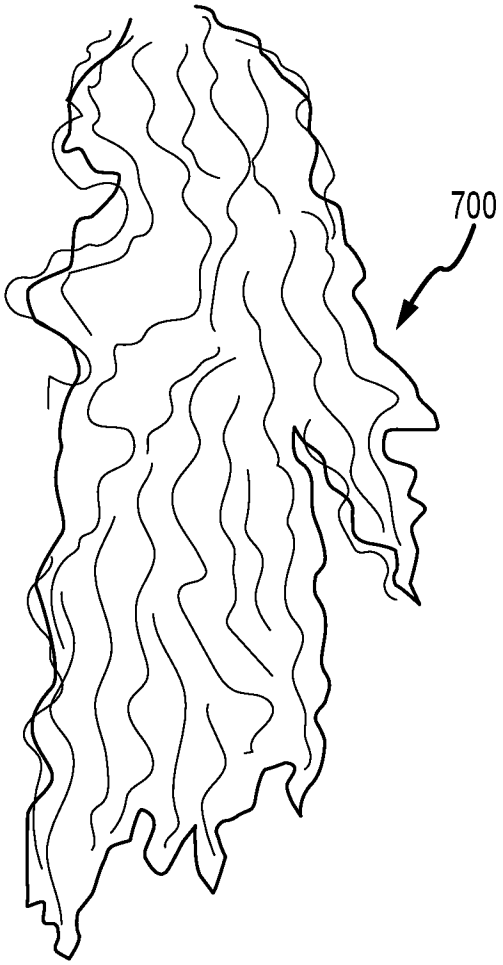
FIG. 7 illustrates a surface covering configured for use as artificial hair or a hairier moss such as Spanish moss.

In addition to the use of the surface covering as artificial moss and grass, there are many other applications in which the new surface covering may be found to be useful. For example, FIG. 7 illustrates a surface covering 700 configured for use as artificial hair for a sculpture or a robotic character. The surface covering 700 has relatively long (e.g., 6 to 18 inches or longer) strands with the outer or second end free of heads/knobs, and the strands have been cut and manipulated to better replicate natural hair. The covering 700 may also be used in place of a variety of plants with a "hairier" fibrous appearance such as Spanish moss.

Figure 8:
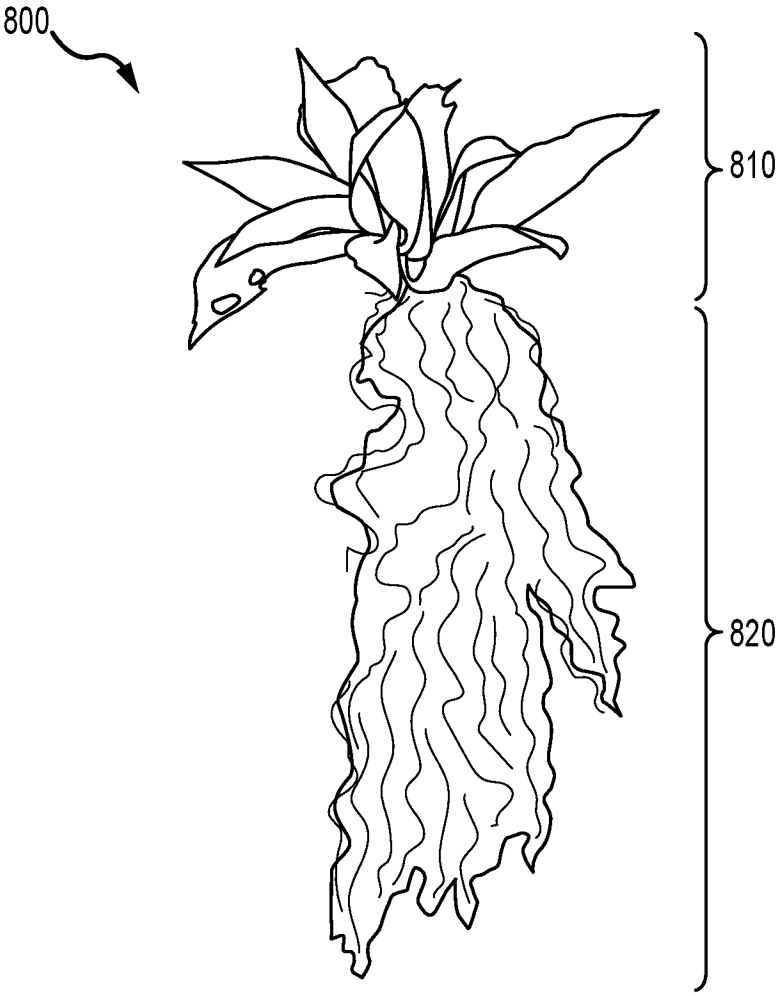
FIG. 8 illustrates a surface covering configured for use as roots of a plant.

As another exemplary use, FIG. 8 illustrates an air plant 800 with an upper portion or body 810 (e.g., with leaves and flowers and the like). An artificial root structure is provided through the use of a surface covering 820 attached to a lower surface or substrate of this body 810 configured for use as roots of a plant. In this case, the "log" of paint-covered fibers would be cut into relatively long slices (or not cut at all as part of the method 400) and manipulated to appear fibrous or to better match the intended root structure's appearance.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

I claim:

1. A surface covering, comprising:

a base for attaching the surface covering to a substrate or surface; and a plurality of strands, wherein the strands each include an elongated body with a first end attached to the base and a second end distal to the first end, wherein the elongated body includes a core and an outer layer coating the core, wherein the core is formed of a metal fiber, wherein the metal fiber comprises a steel wool fiber, and wherein the steel wool fiber comprises a stainless steel wool fiber with a coarseness in the range of 50 to 120 microns.

2. The surface covering of claim 1, wherein the outer layer comprises a layer of a paint.

3. The surface covering of claim 2, wherein the paint comprises an automotive urethane.

4. The surface covering of claim 1, wherein a plurality of the strands each further comprises a head stippled onto the second end.

5. The surface covering of claim 4, wherein the head comprises an integrally colored epoxy.

6. The surface covering of claim 5, wherein the head further comprises a layer of paint on an outward facing surface.

7. The surface covering of claim 1, wherein the base comprises a colored epoxy.

8. A surface covering, comprising:

a plurality of strands, wherein the strands each include an elongated body with a first end attached to the base and a second end distal to the first end, wherein the elongated body includes a core and an outer layer coating the core, wherein the core is formed of a metal fiber, wherein the outer layer comprises a layer of paint, wherein the paint comprises an automotive urethane, wherein a plurality of the strands each further comprises a head stippled onto the second end, and wherein the head comprises an integrally colored epoxy.

9. The surface covering of claim 8, wherein the cores comprise length of a stainless steel wool fiber.

10. A surface covering, comprising:

a base for attaching the surface covering to a substrate or surface; and a plurality of strands, wherein the strands each include an elongated body with a first end attached to the base and a second end distal to the first end, wherein a plurality of the strands each further comprises a head stippled onto the second end, and wherein the head comprises an integrally colored epoxy.

11. The surface covering of claim 10, wherein the head further comprises a layer of paint on an outward facing surface.

12. The surface covering of claim 10, wherein the base comprises a colored epoxy.

13. The surface covering of claim 10, wherein the elongated body includes a core and an outer layer coating the core and wherein the core is formed of a metal fiber.

14. The surface covering of claim 13, wherein the metal fiber comprises a steel wool fiber and wherein the steel wool fiber comprises a stainless steel wool fiber with a coarseness in the range of 50 to 120 microns.

15. The surface covering of claim 10, wherein the outer layer comprises a layer of a paint and wherein the paint comprises an automotive urethane.

16. A surface covering, comprising:

a base for attaching the surface covering to a substrate or surface; and a plurality of strands, wherein the strands each include an elongated body with a first end attached to the base and a second end distal to the first end, wherein the elongated body includes a core and an outer layer coating the core, wherein a plurality of the strands each further comprises a head stippled onto the second end, and wherein the head comprises an integrally colored epoxy.

17. The surface covering of claim 16, wherein the core is formed of a metal fiber.

18. The surface covering of claim 17, wherein the metal fiber comprises a steel wool fiber.

19. The surface covering of claim 18, wherein the steel wool fiber comprises a stainless steel wool fiber with a coarseness in the range of 50 to 120 microns.

20. The surface covering of claim 16, wherein the outer layer comprises a layer of a paint.

21. The surface covering of claim 20, wherein the paint comprises an automotive urethane.

22. The surface covering of claim 16, wherein the head further comprises a layer of paint on an outward facing surface.

23. The surface covering of claim 16, wherein the base comprises a colored epoxy.

24. A surface covering, comprising:

a base for attaching the surface covering to a substrate or surface; and a plurality of strands, wherein the strands each include an elongated body with a first end attached to the base and a second end distal to the first end, wherein the elongated body includes a core and an outer layer coating the core, and wherein the base comprises a colored epoxy.

25. The surface covering of claim 24, wherein the core is formed of a metal fiber.

26. The surface covering of claim 25, wherein the metal fiber comprises a steel wool fiber.

27. The surface covering of claim 24, wherein the outer layer comprises a layer of a paint.

28. The surface covering of claim 27, wherein the paint comprises an automotive urethane.

29. The surface covering of claim 24, wherein a plurality of the strands each further comprises a head stippled onto the second end, wherein the head comprises an integrally colored epoxy, and wherein the head further comprises a layer of paint on an outward facing surface.

30. A surface covering, comprising:

a base for attaching the surface covering to a substrate or surface; and a plurality of strands, wherein the strands each include an elongated body with a first end attached to the base and a second end distal to the first end, wherein a plurality of the strands each further comprises a head stippled onto the second end, and wherein the base comprises a colored epoxy.

31. The surface covering of claim 30, wherein the head comprises an integrally colored epoxy and wherein the head further comprises a layer of paint on an outward facing surface.

32. The surface covering of claim 30, wherein the elongated body includes a core and an outer layer coating the core and wherein the core is formed of a metal fiber.

33. The surface covering of claim 32, wherein the metal fiber comprises a steel wool fiber and wherein the steel wool fiber comprises a stainless steel wool fiber with a coarseness in the range of 50 to 120 microns.

34. The surface covering of claim 30, wherein the outer layer comprises a layer of a paint and wherein the paint comprises an automotive urethane.

* * * * *